United States Patent [19]

Kawahara

[11] 4,322,028

[45] Mar. 30, 1982

[54] KNOCK-DOWN TYPE MAILING PARCEL CASE

[76] Inventor: Yoshinobu Kawahara, 1-32-8 Nishimagome, Ohta-ku, Tokyo, Japan

[21] Appl. No.: 143,947

[22] Filed: Apr. 25, 1980

[51] Int. Cl.[3] ..... B65D 5/02

[52] U.S. Cl. ..... 229/40; 229/87.5; 229/92.7

[58] Field of Search ..... 229/40, 87.5, 92, 92.3, 229/92.7, 92.9

[56] References Cited

U.S. PATENT DOCUMENTS

| | | | |
|---|---|---|---|
| 861,748 | 7/1907 | Mitchell | 229/92.8 |
| 1,339,339 | 5/1920 | Hoffman | 229/40 |
| 1,689,637 | 10/1928 | Mordecai | 229/87.5 X |
| 3,114,492 | 12/1963 | Engström | 229/40 X |
| 3,391,782 | 7/1968 | Kaspan | 229/40 X |
| 3,392,900 | 7/1968 | Vogt | 229/40 X |
| 3,455,499 | 7/1969 | Anderson | 229/40 |
| 3,834,610 | 9/1974 | Eifrid | 229/40 |
| 3,964,669 | 6/1976 | Sontag et al. | 229/40 |
| 4,244,511 | 1/1981 | Coleman | 229/92.7 X |

*Primary Examiner*—Herbert F. Ross

*Attorney, Agent, or Firm*—Pearne, Gordon, Sessions, McCoy & Granger

[57] ABSTRACT

A knock-down type mailing parcel case which comprises a rectangular cardboard main body having the opposite inwardly folded side edges and a pair of rectangular cardboard flaps extending perpendicular to the longitudinal axis of the main body and secured at one end to the folded side edges. The flaps have the length substantially greater than one half of the width of the main body, but smaller than the full width of the main body so that the flaps overlap one upon another covering a substantial area of the flaps. The flaps have folding lines extending transversely of the flaps and positioned adjacent to the secured ends and the main body has two groups of folding lines extending transversely of the main body and positioned adjacent to and outside the folding lines on the flaps.

8 Claims, 3 Drawing Figures

KNOCK-DOWN TYPE MAILING PARCEL CASE

BACKGROUND OF THE INVENTION

This invention relates to a novel and improved mailing parcel case and more particularly, to a novel and improved knock-down type mailing parcel case which can rapidly and positively pack articles having varying dimensions to be mailed such as books.

There have been proposed and practically employed a variety of mailing parcel cases, but the prior art mailing parcel cases require tedious manual handling and a rather long time period for packing books having particular dimensions and contours therein. Furthermore, the prior art mailing parcel cases are not versatile to pack articles having varying dimensions and contours and often encounter difficulty in packing such articles therein.

SUMMARY OF THE INVENTION

Therefore, one object of the present invention is to provide a knock-down type mailing parcel case which can effectively eliminate the disadvantages inherent in the prior art mailing parcel cases.

Another object of the present invention is to provide a knock-down type mailing parcel case which can rapidly and easily pack articles having varying dimensions.

A still further object of the present invention is to provide a knock-down type mailing parcel case which provides a multi-layered parcel receiving section to thereby positively and safely pack an article therein.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

PREFERRED EMBODIMENT OF THE INVENTION

The present invention will be now described referring to the accompanying drawings which show one preferred embodiment of the knock-down type mailing parcel case of the present invention for illustration purpose only, but not for limiting the invention in any way.

Figure 1:
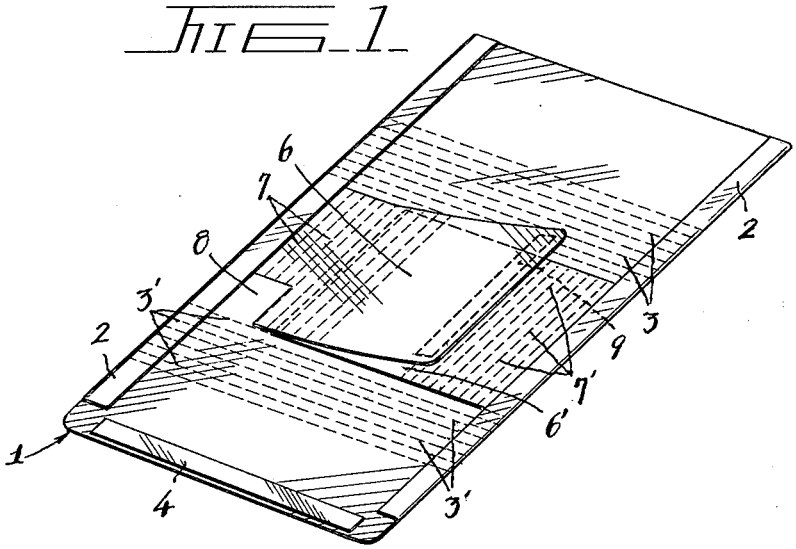
FIG. 1 is a developed perspective view of one preferred embodiment of the knock-down type mailing parcel case constructed in accordance with the principle of the present invention showing the inner structure of the case.
Figure 2:
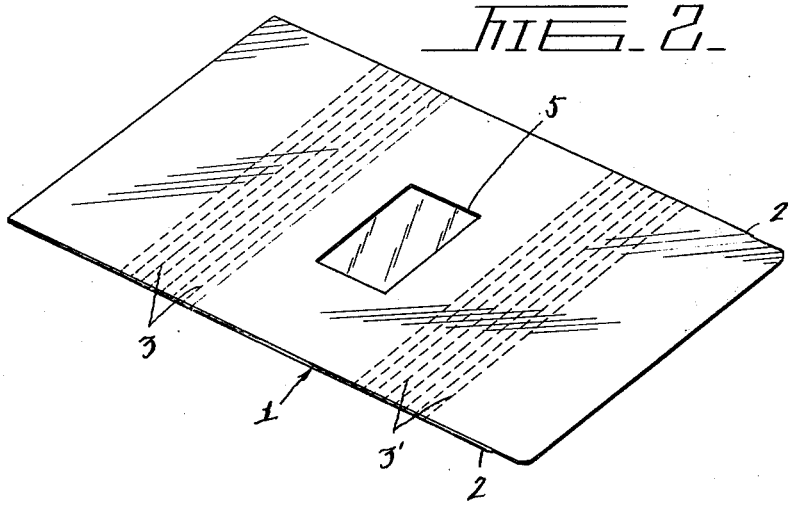
FIG. 2 is a developed perspective view of said knock-down type mailing parcel case of FIG. 1 showing the external appearance of the case.

Referring to the accompanying drawings and more particularly, to FIG. 1 thereof, the knock-down type mailing parcel case of the invention generally comprises a rectangular main body 1 which is made of a relatively rigid and thick paper such as a sheet of cardboard, for example. The main body 1 is inwardly folded at the opposite side edges thereof as shown by reference numeral 2 and the folded side edges abut against and are glued to the inner surface of the main body 1 for the purpose to be described hereinafter. The outer surface of the main body 1 is formed with a first group of parallel and spaced folding lines 3 extending transversely of the main body perpendicular to the longitudinal axis of the main body in a position between one end and the center of the length of the main body and with a second group of parallel and spaced folding lines 3' extending transversely of the main body perpendicular to the longitudinal axis thereof in a position between the other end and the above-mentioned center of the main body. An elongated adhesive tape 4 having opposite adhesive surfaces is secured on one adhesive surface thereof to the inner surface of the main body 1 adjacent to one end of the main body. A rectangular through opening or window 5 is provided in the main body 1 at the center area of the latter and a transparent film (not shown) is adapted to be secured to the periphery defining the opening 5 in the main body for the purpose to be described hereinafter.

A first or upper rectangular flap piece 6 is secured at one end to the main body 1 under one of the folded side edges 2 with the longitudinal axis of the flap piece extending perpendicular to the longitudinal axis of the main body 1. A group of parallel and spaced folding lines 7 is formed on the outer surface of the flap piece 6 adjacent to the secured one end thereof and extends transversely of the flap piece. The folding lines 7 terminate at the opposite ends short of the opposite side edges of the flap piece 6. An inspection notch 8 is provided in the flap piece 6 adjacent to the secured end and one of the opposite side edges of the flap piece. An adhesive tape 9 having opposite adhesive surfaces is secured on one adhesive surface thereof to the inner surface of the first flap piece 6 adjacent to the other or free end of the latter and the longitudinal axis of the adhesive tape 9 extends perpendicular to the longitudinal axis of the associated flap piece. The adhesive tape 9 terminates at the opposite ends short of the opposite side edges of the flap piece 6.

A second or lower rectangular flap piece 6' is similarly secured at one end to the main body 1 under the other folded side edge 2 with the longitudinal axis of the flap piece extending perpendicular to the longitudinal axis of the main body 1. A group of parallel and spaced folding lines 7' is formed on the outer surface of the flap piece 6' adjacent to the secured end thereof and extends transversely of the associated flap piece. The folding lines 7' terminate at the opposite ends short of the opposite side edges of the flap piece 6'. The ends of the flap pieces 6, 6' secured to the main body 1 are secured to the main body under the folded side edges 2,2 thereof when the folded side edges of the main body are secured to the inner surface of the main body by means of a suitable gluing material (not shown).

Figure 3:
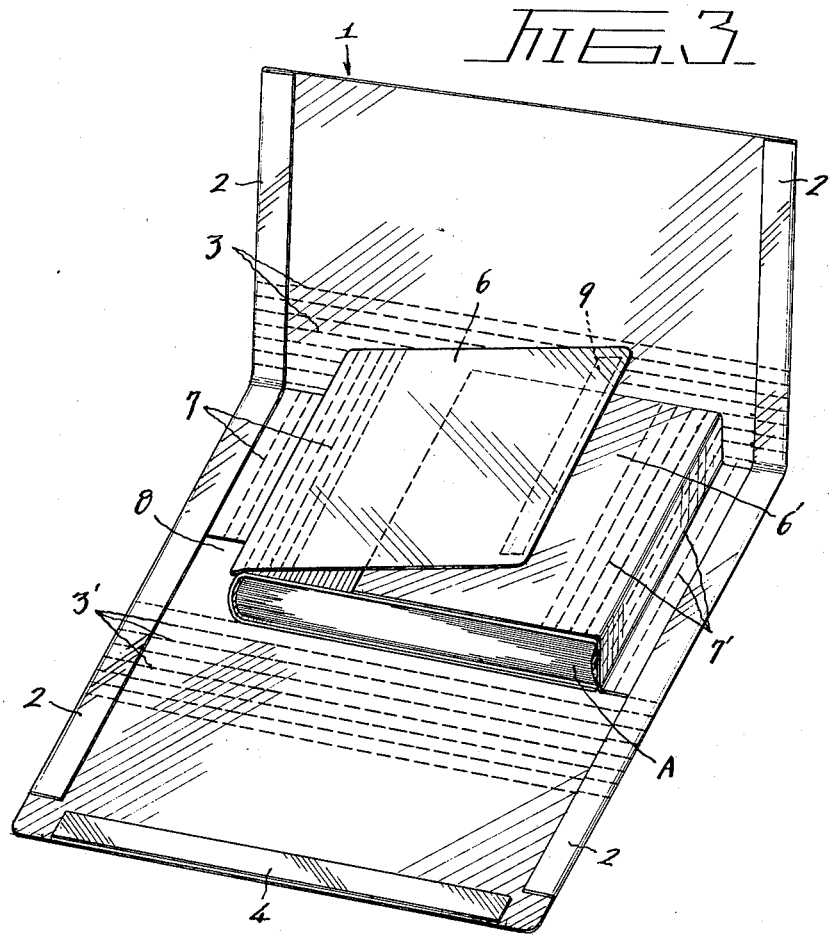
FIG. 3 is a perspective view of said knock-down type mailing parcel case of FIGS. 1 and 2 on an enlarged scale showing the case in a partially folded position.

The length of the flap pieces 6, 6' is substantially greater then one half of the width of the main body 1, but slightly smaller than the full width of the main body so that the flap pieces 6, 6' overlap one upon another covering a substantial area of the flap pieces with the free end portion of the flap piece 6 overlying the free end portion of the flap piece 6' when the flap pieces are folded. The flap pieces 6, 6' are formed of the same material as that of the main body 1. In FIG. 3, reference character A denotes an article to be mailed in the case such as a book.

With the above-mentioned construction and arrangement of the components of the knock-down type mailing parcel case of the invention, in use, the case is laid in an open position on a suitable support surface (not shown) with the flap pieces 6, 6' forced open by human hands and the book A is placed onto the inner surface of the main body 1 at the area thereof which lies under the flap pieces 6, 6' whereupon the manual force which forces the flap pieces 6, 6' to open is released from the flap pieces so that the flap pieces are allowed to lie over the book A. Thereafter, the flap pieces 6, 6' are folded at a selected one of the folding lines 7, 7' on the flap pieces 6, 6', respectively, in conformity with the dimensions and contour of the book A and similarly, the main body 1 is then folded at a selected one of the folding lines 3, 3', respectively, in conformity with the dimensions and contour of the book A. It will be understood that when the flap pieces 6, 6' are folded together, they are folded in such a manner that the flap piece 6 lies over the flap piece 6' and that the main body 1 is folded in such a manner that the end portion of the main body having the adhesive tape 4 lies over the other end portion of the main body having no adhesive tape. Thereafter, a manual holding down force is applied to the folded mailing parcel case so as to cause the flap pieces 6, 6' to be secured together by means of the adhesive tape 9 and to cause the two end portions of the main body 1 to be secured together by means of the adhesive tape 4 whereby the book A can be firmly held in position within the folded mailing parcel case.

Prior to the folding of the main body 1, an address card (not shown) is positioned on the inner surface of the main body 1 in the position just below the opening or window 5 and the book A placed in the case can be viewed through the notch 8 in the flap piece 6 so that the case containing the book A is processed as a third class mailing matter.

As clear from the foregoing description on the preferred embodiment of the knock-down type mailing parcel case of the invention, the flap pieces and main body are folded in conformity with the dimensions and contour of an article to be placed into the case and the adhesive tapes 4, 9 firmly secure the main body and flap pieces together to thereby firmly position the article within the case. The folded case provides a multi-layered article receiving section in the case.

While only one embodiment of the invention has been shown and described in detail, it will be understood that the same is for illustration purpose only and not to be taken as a definition of the invention, reference being had for this purpose to the appended claims.

What is claimed is:

1. A knock-down type mailing parcel case which comprises a rectangular main body having the opposite side edges inwardly folded and glued to the inner surface of said main body, first and second spaced groups of transverse folding lines on said main body adjacent to and spaced from the center of the length of the main body, each group of said folding lines including a number of parallel and spaced folding lines, and an adhesive tape having opposite adhesive surfaces one of which is secured to the inner surface of said main body adjacent to a first end of the main body; and first and second rectangular flap pieces each having one end secured to said inner surface of the main body under the associated inwardly folded side edge of the main body at the center area of the main body and the longitudinal axis thereof extending perpendicularly to the longitudinal axis of the main body, said flap pieces each having a length substantially greater than one half of the width of said main body, but slightly smaller than the full width of the main body, and a group of parallel and spaced transverse folding lines on each of the flap pieces adjacent to the respective secured ends thereof, and one of said flap pieces further including an adhesive tape having opposite adhesive surfaces one of which is secured to the inner surface of the associated flap piece.

2. The knock-down type mailing parcel case as set forth in claim 1, in which said first and second groups of transverse folding lines on the main body are positioned adjacent to and outside the opposite side edges of said first and second flap pieces.

3. The knock-down type mailing parcel case as set forth in claim 1, in which the free end portions of said first and second flap pieces overlap one upon another when the flap pieces are folded.

4. The knock-down type mailing parcel case as set forth in claim 1, wherein the flap piece having said adhesive tape lies over the other flap piece when the flap pieces are folded.

5. The knock-down type mailing parcel case as set forth in claim 1, in which said main body has a through opening at the center area of the main body and a transparent film is secured across said opening.

6. The knock-down type mailing parcel case as set forth in claim 4, in which said flap piece having the adhesive tape is provided with an inspection notch adjacent to said secured end.

7. The knock-down type mailing parcel case as set forth in claim 1, in which said folding lines on the main body are provided on the outer surface thereof.

8. A knock-down type mailing parcel case which comprises a rectangular main body having opposite side edges and first and second opposite ends, first and second spaced groups of transverse folding lines on said main body adjacent to and spaced from an intermediate area of the length of the main body, each group of said folding lines including a number of parallel and spaced folding lines, and an adhesive on the inner surface of said main body adjacent to said first end of the main body; and first and second rectangular flap pieces each having one end secured to said inner surface of the main body at the associated side edge of the main body at the intermediate area of the main body and the longitudinal axis thereof extending perpendicularly to the longitudinal axis of the main body, said flap pieces each having a length substantially greater than one half of the width of said main body, but slightly smaller than the full width of the main body, and a group of parallel and spaced transverse folding lines on each of the flap pieces adjacent to the respective secured ends thereof, said first flap piece further including an adhesive on the inner surface near the distal end thereof, and an inspection notch cut into one of said flap pieces at the secured end thereof.

* * * * *